US008698676B2

(12) United States Patent
Ikuta

(10) Patent No.: US 8,698,676 B2
(45) Date of Patent: Apr. 15, 2014

(54) MOBILE COMMUNICATION HANDSET

(75) Inventor: Shoichi Ikuta, Kanagawa (JP)

(73) Assignee: NEC Casio Mobile Communications, Ltd., Kawasaki-Shi, Kanagawa (JP)

( * ) Notice: Subject to any disclaimer, the term of this patent is extended or adjusted under 35 U.S.C. 154(b) by 509 days.

(21) Appl. No.: 13/067,178

(22) Filed: May 13, 2011

(65) Prior Publication Data

US 2011/0287818 A1 Nov. 24, 2011

(30) Foreign Application Priority Data

May 18, 2010 (JP) ..... 2010-114728

(51) Int. Cl.
*H01Q 1/24* (2006.01)

(52) U.S. Cl.
USPC ..... 343/702

(58) Field of Classification Search
USPC ..... 343/702
See application file for complete search history.

(56) References Cited

U.S. PATENT DOCUMENTS 7,262,736 B2 * 8/2007 Sunaga ..... 343/702
2010/0069017 A1 * 3/2010 Yamamoto et al. ..... 455/68

FOREIGN PATENT DOCUMENTS

JP 2005-341027 A 12/2005
JP 2006-311599 A 11/2006

* cited by examiner

*Primary Examiner* — Kristy A Haupt
(74) *Attorney, Agent, or Firm* — McGinn IP Law Group, PLLC

(57) ABSTRACT

An antenna module (5) is such that an antenna and two power supply points for that antenna are formed on a thin substrate. A substrate module (7) has a substrate, two power supply point contact units that respectively electrically contact the two power supply points attached to the substrate, and electronic components, and processes signals received via the power supply point contact units through a circuit formed by electronic components and the power supply contact units. A pressure plate (6) is positioned between the antenna module (5) and the substrate and anchors the antenna module (5) by pressing the entire surface of such against an outside case (20), excluding the power supply points, by the outside case (20) and an inside case (21) being fastened together.

10 Claims, 11 Drawing Sheets

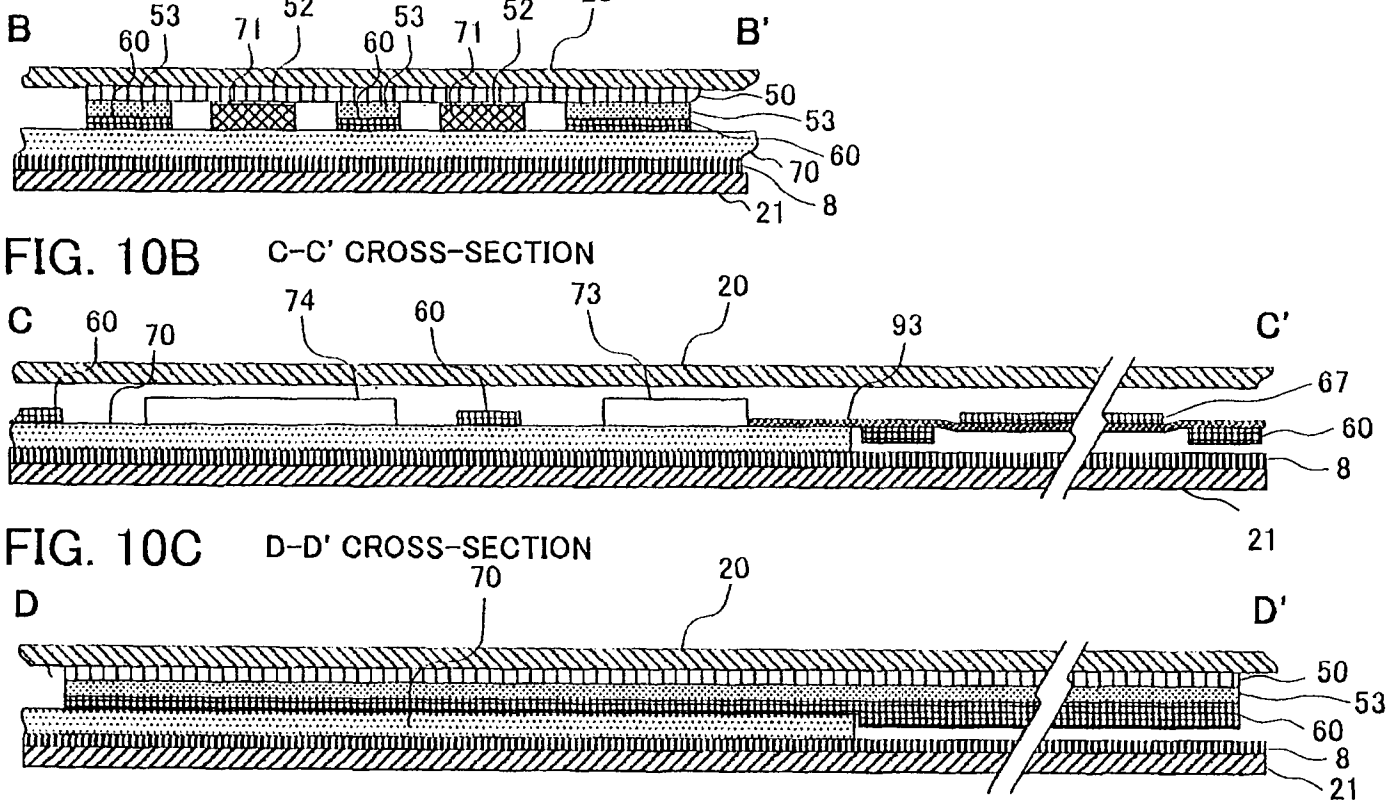
FIG. 10A B-B' CROSS-SECTION
FIG. 10B C-C' CROSS-SECTION
FIG. 10C D-D' CROSS-SECTION

MOBILE COMMUNICATION HANDSET

INCORPORATION BY REFERENCE

This application is based on Japanese. Patent Application No. 2010-114728 filed on May 18, 2010, and including specification; claims, drawings and summary. The disclosure of the above Japanese Patent Application is incorporated herein by reference in its entirety.

TECHNICAL FIELD

The present invention relates to a mobile communication handset, and more particularly to a mobile communication handset with a built-in thin antenna.

BACKGROUND ART

In recent years, technology relating to mobile communications such as cell phones has been rapidly developing. Antennas in cell phone handsets are particularly important devices, and as handset casings have become thinner and more compact, the need for antennas to become more compact, thinner and embedded has arisen.

Besides antennas used in usual communications, there are also antennas used in non-contact telecommunications, such as in the case of incorporating FeliCa (registered trademark) and other non-contact IC cards in cell phone handsets and using these as electronic money, or using antennas for RFID (Radio Frequency Identification). Consequently, there is a growing need for antennas to become more compact, thinner and embedded.

Unexamined Japanese Patent Application KOKAI Publication No. 2005-341027 (Patent Literature 1) discloses an example of a mobile communication handset used in non-contact telecommunications. The mobile communication handset noted in Patent Literature 1 includes a first casing having an input mechanism with which a user can accomplish input operations, a non-contact telecommunications unit for accomplishing close-range wireless communications with external devices, a second casing having a display unit for displaying the communications status of the non-contact telecommunications unit and the input contents of the input mechanism, and a hinge mechanism for joining the first casing and the second casing so as to be capable of opening and closing such. The non-contact telecommunications unit has an antenna the back of which faces the display unit and which wraps around an opening permitting magnetic flux to pass through, this antenna being formed as a pattern on a substrate, with an antenna adjustment circuit and a non-contact IC and the like being incorporated on the substrate.

Unexamined Japanese Patent Application KOKAI Publication No. 2006-311599 (Patent Literature 2) discloses a mobile wireless apparatus that secures adequate built-in antenna height and improves communications properties (antenna properties) while aiming for greater case compactness. The mobile wireless apparatus noted in Patent Literature 2 includes an antenna storage board, a circuit board and a built-in antenna, and with this composition order has a composition such that the components are spaced and arranged so as to not be coplanar while being electrically connected.

SUMMARY

In Patent Literature 1, the antenna is formed as a pattern on a substrate, and a signal processing circuit in which an antenna adjustment circuit and a non-contact IC and the like are assembled is formed on the same substrate. Consequently, the problem arises that communications properties change (deteriorate) due to effects from the substrate.

In Patent Literature 2, the antenna and the substrate are not formed on the same plane but on different planes, a distance between the two is held and effects from the substrate on the antenna are reduced. However, when the antenna is made a thin antenna formed on a thin substrate, the arrangement or distance between the two easily changes. If the mobile communication handset is subject to impact as the mobile communication handset is dropped, this distance and arrangement change. When such changes occur, the resonance frequency of the antenna changes, and the problem arises that as a result the communications properties change.

In consideration of the foregoing, it is an exemplary object of the present invention to provide a built-in thin antenna and reduce changes in communications properties.

In order to achieve the above exemplary object, the mobile communication handset according to the present invention includes an antenna housing unit having:

an antenna module in which an antenna and two power supply points for the antenna are formed on a thin substrate;

a substrate module including a substrate, two power supply point contact units for electrically contacting the two power supply points, and electronic components, and having a circuit formed on the substrate and containing the electronic components and the power supply point contact unit attached on the substrate, the substrate module processing signals received from the circuit via the power supply point contact unit; and an outside case and an inside case for housing the antenna module and the substrate module;

wherein the mobile communication handset includes a pressure plate positioned between the antenna module and the substrate, and has openings for the power supply points positioned facing the power supply points, with the entire surface of the antenna module, with the exception of the power supply points, being pressed against and anchored to the outside case by fastening the outside case and the inside case together.

With the present invention, it is possible to reduce changes in the communications properties of an antenna formed on a thin substrate.

BRIEF DESCRIPTION OF THE DRAWINGS

These objects and other objects and advantages of the present invention will become more apparent upon reading of the following detailed description and the accompanying drawings in which:

FIG. 10A is a cross-sectional view along line B-B' in the mobile communication handset in FIG. 9, FIG. 10B is a cross-sectional view along line C-C' in the mobile communication handset in FIG. 9 and FIG. 10C is a cross-sectional view along line D-D' in the mobile communication handset in FIG. 9.

EXEMPLARY EMBODIMENT

Figure 1:
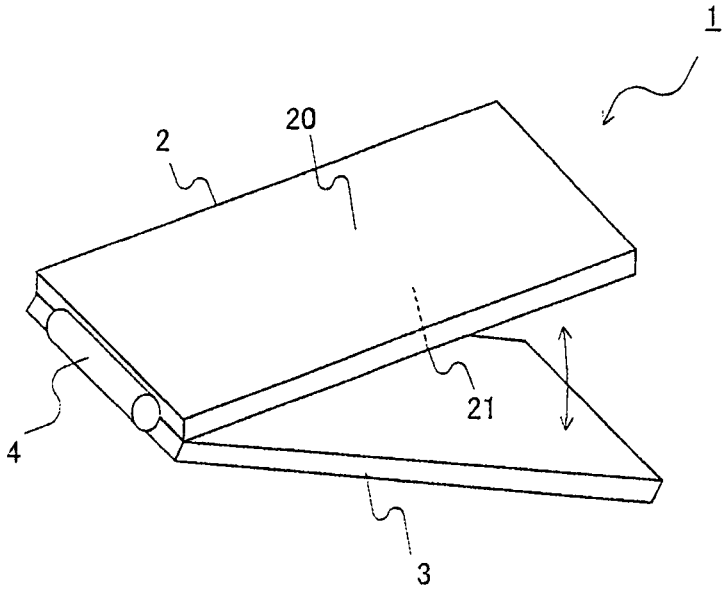
FIG. 1 shows a typical exemplary composition of a mobile communication handset.

Hereinafter, a mobile communication handset equipped with an antenna for FeliCa or RFID (hereafter abbreviated as "RFID antenna") according to the present invention will be described with reference to the drawings. FIG. 1 shows an example of a typical composition of a mobile communication handset. A mobile communication handset 1 shown in FIG. 1 includes an RFID antenna, an antenna housing unit 2 equipped with a circuit for processing signals received from the RFID antenna, an operation unit 3 equipped with a key operation unit and a circuit for accomplishing those processes, and a hinge connecting the antenna housing unit 2 and the operation unit 3 so as to be capable of opening and closing. The present invention relates to the antenna housing unit 2.

Figure 2:
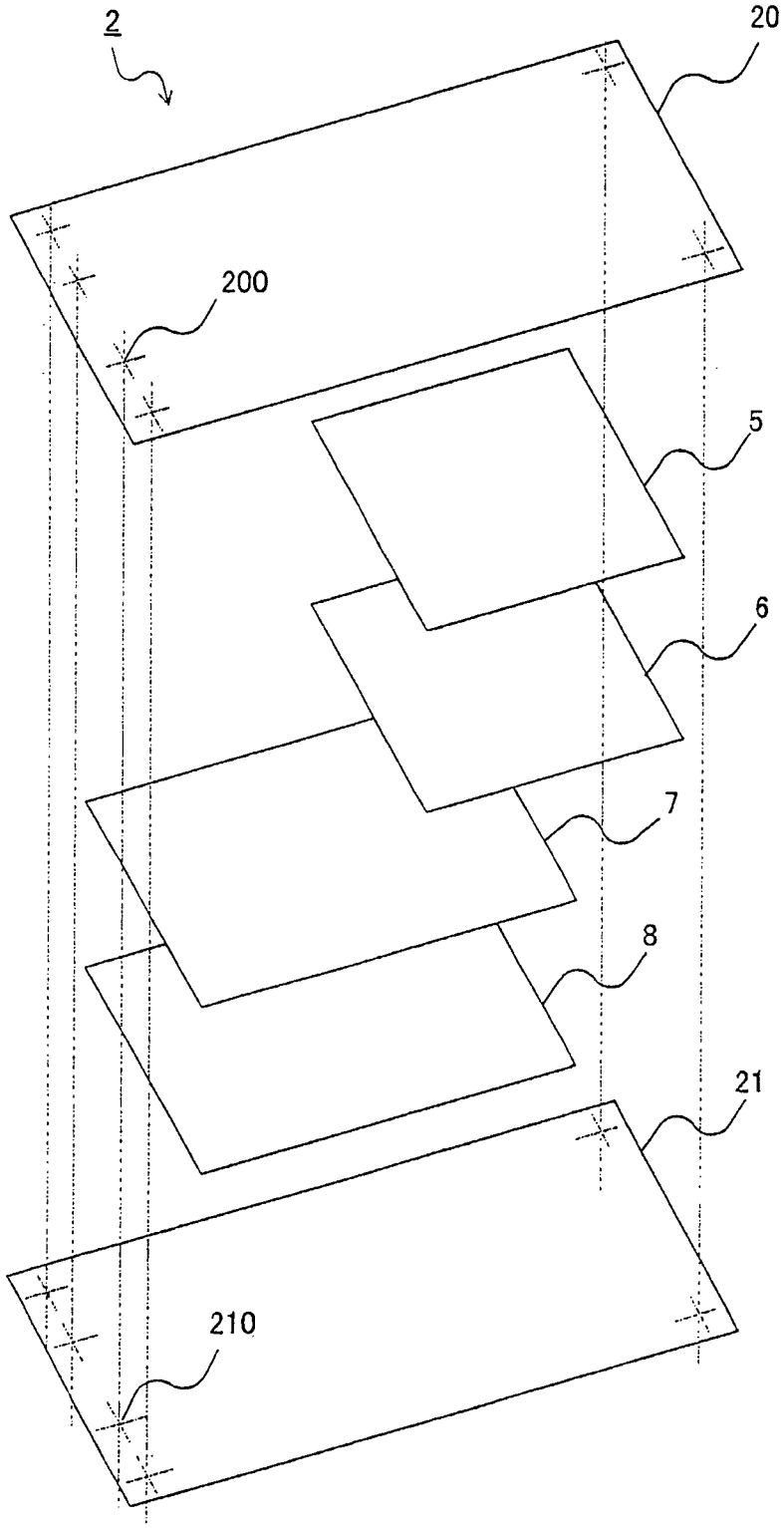
FIG. 2 shows an exemplary arrangement of constituent elements of an antenna housing unit in a mobile communication handset according to an exemplary embodiment of the present invention.

FIG. 2 is a drawing showing an exemplary arrangement of constituent elements of the antenna housing unit of the mobile communication handset according to an exemplary embodiment of the present invention. The constituent elements in FIG. 2 are shown as a schematic diagram, and details of the elements such as thickness, shape, openings and the like are omitted. The antenna housing unit 2 of the mobile communication handset 1 includes an outside case 20 and an inside case 21. An antenna module 5, a pressure plate 6, a substrate module 7 and a metal plate 8 are arranged in order between the outside case 20 and the inside case 21. These components are interposed between the outside case 20 and the inside case 21 and are fastened so as to be a single unit by a fastener unit 200 and a fastener unit 210. For example, the metal plate 8 is composed for the SUS (Steel Used Stainless). The fastener units 200 and 210 may be screwed shut, for example. The various constituent elements are described below.

In order to fasten the fastener units 200 and 210, a hook joint may be included. In addition, the fastener units 200 and 210 may be anchored by being mutually pressed together by pressure.

Figure 3A:
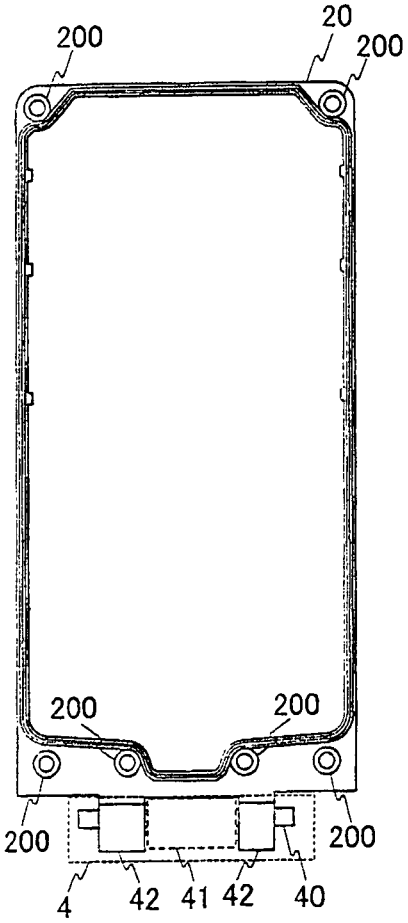
FIG. 3A shows an example of the outside case of a mobile communication handset according to an exemplary embodiment.
Figure 3B:
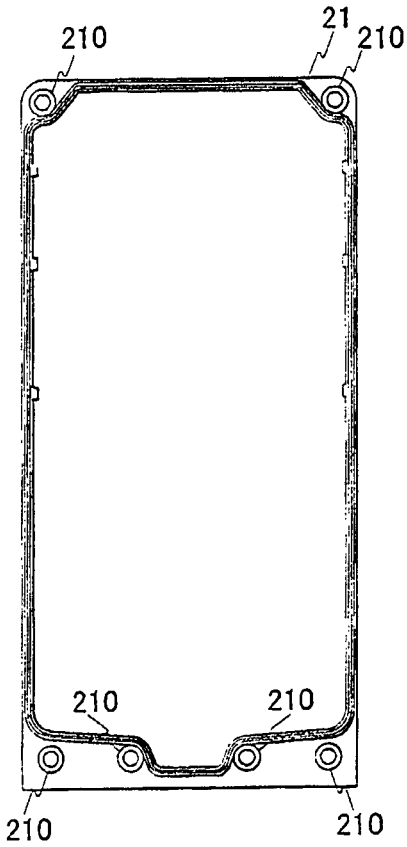
FIG. 3B shows an example of the inside case of a mobile communication handset according to an exemplary embodiment.

FIG. 3A shows an example of the outside case of a mobile communication handset according to the exemplary embodiment and FIG. 3B shows an example of the inside case of a mobile communication handset according to the exemplary embodiment. As shown in these drawings, an outside case 20 and an inside case 21 are each provided near the outer perimeter with the fastener units 200 and 210 in order to fasten the two together. The outside case 20 is provided with a hinge unit 4 for rotatably connecting the operation unit 3. The part of the hinge unit 4 belonging to the outside case 20 is an antenna housing unit hinge 42. Although omitted from the drawing, there is an operation unit hinge 41 in the operation unit 3, and the antenna housing unit hinge 42 and the operation unit hinge 41 are rotatably fastened by a hinge shaft 40 that is the center of rotation. Between the outside case 20 and the inside case 21, the antenna module 5, the substrate module 7 and the like are housed and protected, with the cases made of a solid, lightweight material such as resin. Normally, a display unit (unrepresented) is provided on the surface of the inside case 21 facing the operation unit 3.

Figure 4A:
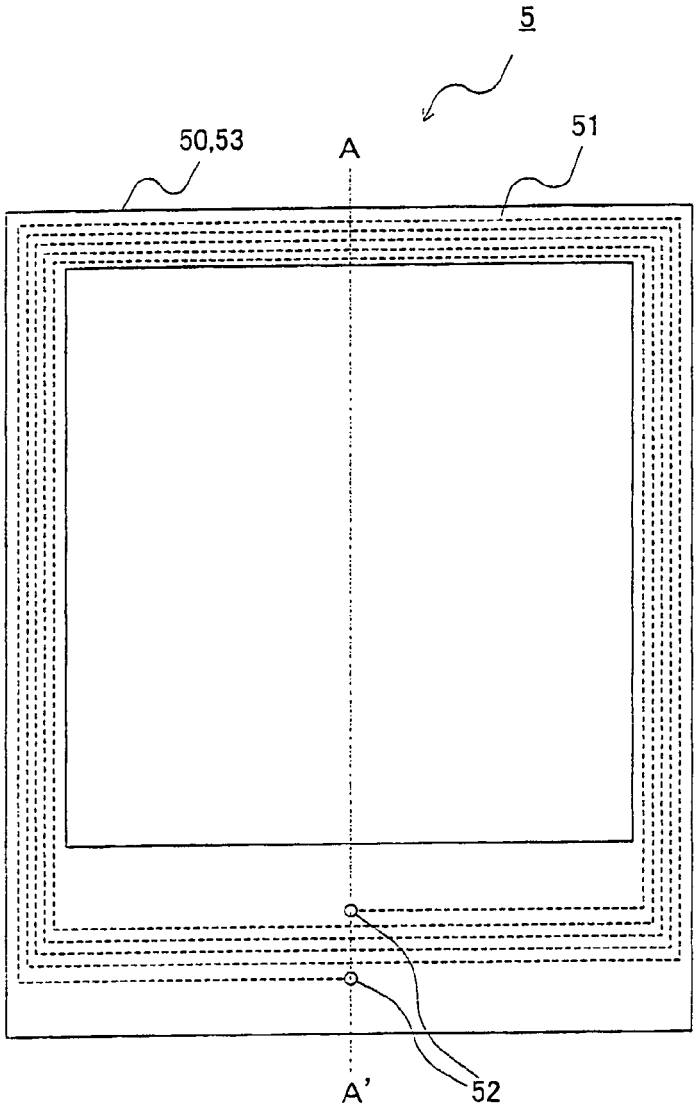
FIG. 4A is a planar view of an exemplary composition of an antenna module in a mobile communication handset according to an exemplary embodiment.
Figure 4B:
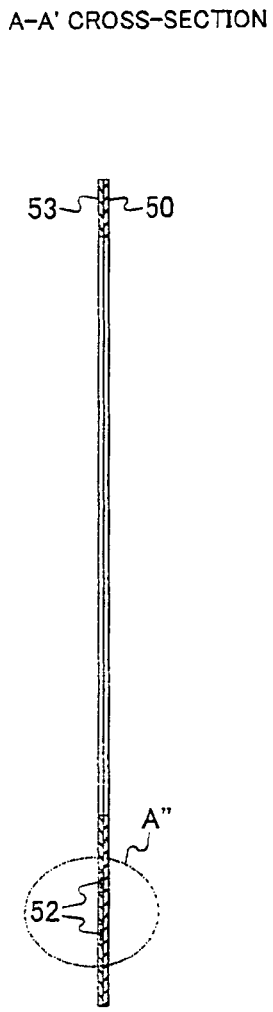
FIG. 4B is a cross-sectional view along line A-A' showing an exemplary composition of the antenna module in a mobile communication handset according to an exemplary embodiment.
Figure 4C:
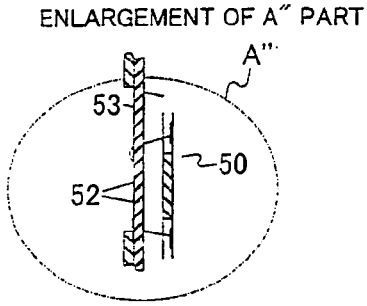
FIG. 4C is an enlargement of section A" in the cross-sectional view along line A-A' in the antenna module in a mobile communication handset according to an exemplary embodiment.

FIG. 4A is a planar view of an exemplary composition of the antenna module in the mobile communication handset according to the exemplary embodiment, FIG. 4B is a cross-sectional view along line A-A' showing an exemplary composition of the antenna module in the mobile communication handset according to the exemplary embodiment, and FIG. 4C is an enlargement of section A" in the cross-sectional view along line A-A' in the antenna module in the mobile, communication handset according to the exemplary embodiment. FIG. 4A shows the RFID antenna formation surface, with line A-A' being an axis of symmetry for the RFID antenna formed on the antenna formation surface. As shown in FIG. 4A, the antenna module 5 is provided with a thin substrate 50 formed by an insulator, an RFID antenna 51 formed on the thin substrate 50 or between the thin substrate 50 and the magnetic sheet 53, and two power supply points 52 for the RFID antenna 51. The power supply points 52 are exposed so that conductive contact with an external unit is possible. This composition can be realized by forming the RFID antenna 51 and the power supply points 52 through patterning of a material such as aluminum, copper or the like on the thin substrate 50 and then making holes near the power supply points 52 and forming an insulator film thereon. The power supply points 52 are arranged near the antenna axis of symmetry A-A' but not be limited to this arrangement.

The thin substrate 50 is thinner than a substrate 70 (see FIG. 6) used in the below-described substrate module 7, and has a thickness that satisfies the insulating properties required by the antenna. The antenna formed on the thin substrate 50 shall be called a thin antenna. The thin substrate 50 includes flexible substrates, and in the explanation below the thin substrate 50 shall be assumed to be a flexible substrate 50.

The antenna module 5 may also be provided with a magnetic sheet. As shown in FIGS. 4B and 4C, a magnetic sheet 53 is attached on the surface of the antenna module 5 on which the power supply points 52 are exposed, except near the power supply points 52. Through this, the power supply points 52 can be conductively connected to an external unit even after the magnetic sheet 53 is attached. Double-sided adhesive tape, for example, may be used for attachment.

Figure 5:
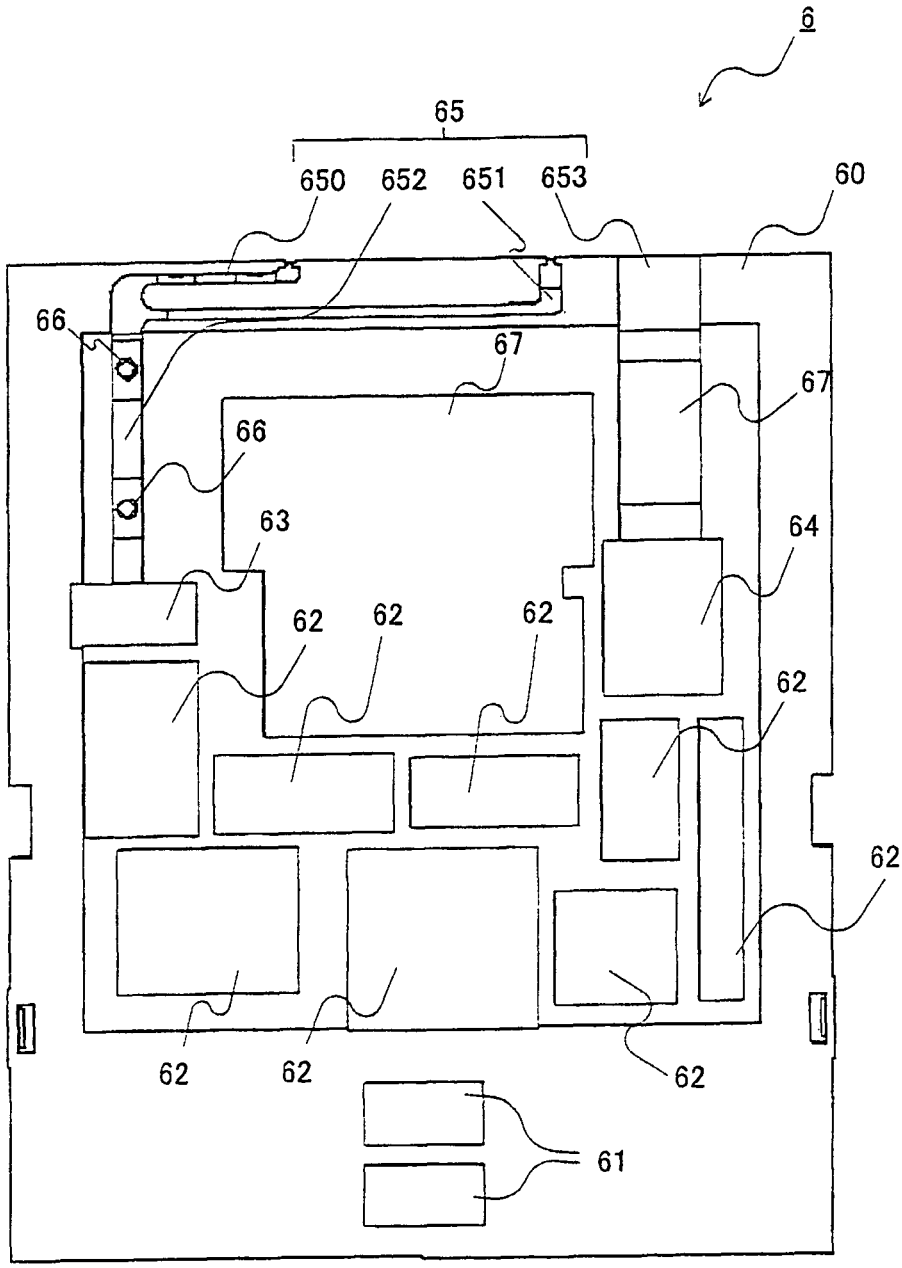
FIG. 5 shows an example of a pressure plate in a mobile communication handset according to an exemplary embodiment.

FIG. 5 shows an example of a pressure plate in the mobile communication handset according to the exemplary embodiment. A pressure plate 6 is composed of an antenna pressing unit 60 in which are formed multiple openings including power supply point openings 61, cable grooves and anchoring units for anchoring cables. In the example shown in FIG. 5, the pressure plate 6 also has electronic component openings 62, a cable A connection opening 63, and a cable B connection opening 64 as openings with the exception of the power supply point openings 61, and has a cable groove unit 65 as cable grooves. The power supply point openings 61 are provided in two independent locations, respectively facing the two power supply points 52. Furthermore, there is an antenna pressing unit 60 for the pressure plate 6 in a position facing between the two power supply points 52.

The cable groove unit 65 has a groove 650 for a cable A1, a groove 651 for a cable A2, a groove 652 for the cable A and a groove 653 for the cable B. The anchoring unit for anchoring cables has a cable A anchoring unit 66 and a cable B anchoring unit 67. The pressure plate is formed of an insulating material. The pressure plate 6 may be formed of a non-conductive material or magnetic material having insulating properties, or may be formed of a non-conductive material or magnetic material coated with an insulating material.

Figure 6:
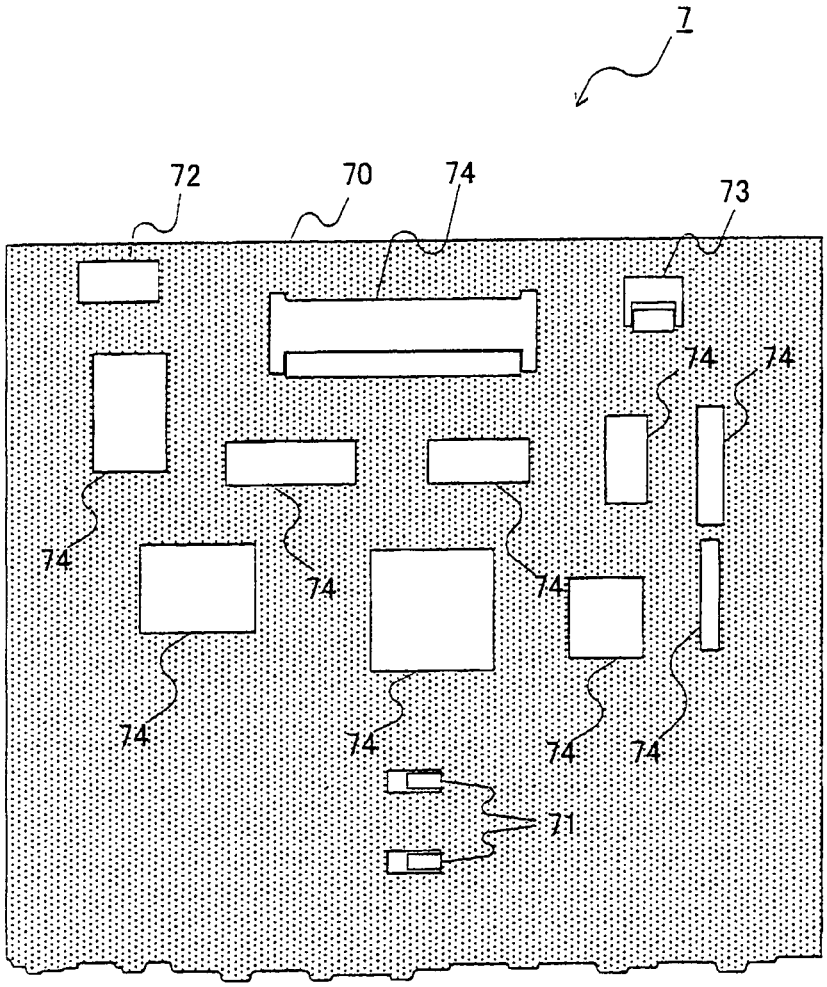
FIG. 6 shows an example of a substrate module in a mobile communication handset according to an exemplary embodiment.

FIG. 6 shows an example of a substrate module in the mobile communication handset according to the exemplary embodiment. The substrate module 7 is composed of a substrate 70, a power supply point contact unit 71 attached on the substrate 70, a cable A connection unit 72, a cable B connection unit 73 and electronic components 74. Circuits including the power supply point contact units 71, the cable A connection unit 72, the cable B connection unit 73 and the electronic components 74 are formed on the substrate 70. The power supply point contact units 71 are spring contacts and make conductive contact with the power supply points 52 of the antenna module 5. Below-described equipment (built-in equipment) housed in the mobile communication handset 1, and cables for sending and receiving signals between circuits formed on the substrate 70, are connected to the cable A connection unit 72 and the cable B connection unit 73. The cable A connection unit 72 and the cable B connection unit 73 may be electronic components 74 in a broader sense comprising circuits formed on the substrate 70. In FIG. 6, the portion of the substrate module 7 at the bottom of the page is omitted from the drawing.

Figure 7:
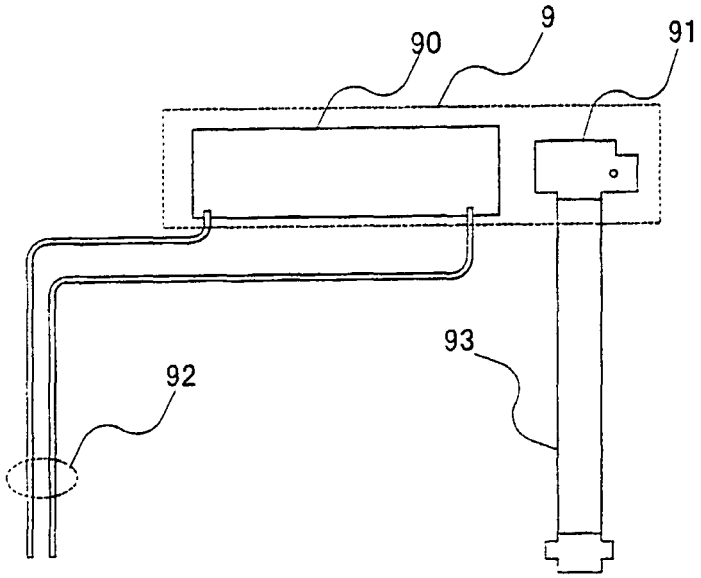
FIG. 7 shows an example of built-in equipment installed in a mobile communication handset according to an exemplary embodiment.

FIG. 7 shows an example of built-in equipment installed in the mobile communication handset according to the exemplary embodiment. Built-in equipment 9 is composed of audio equipment and optical sensors and the like. In FIG. 7, two types of built-in equipment A 90 and built-in equipment B 91 with which the built-in equipment 9 is provided are shown. The built-in equipment A 90 and built-in equipment B 91 are connected a cable A 92 and a cable B 93 for sending and receiving signals between circuits formed on the substrate 70 via the cable A connection unit 72 and the cable B connection unit 73 attached to the substrate 70. Here, an example is shown in which cable A 92 is composed of two single-core cables and cable B 93 is composed of a flat multi-core cable.

Figure 8:
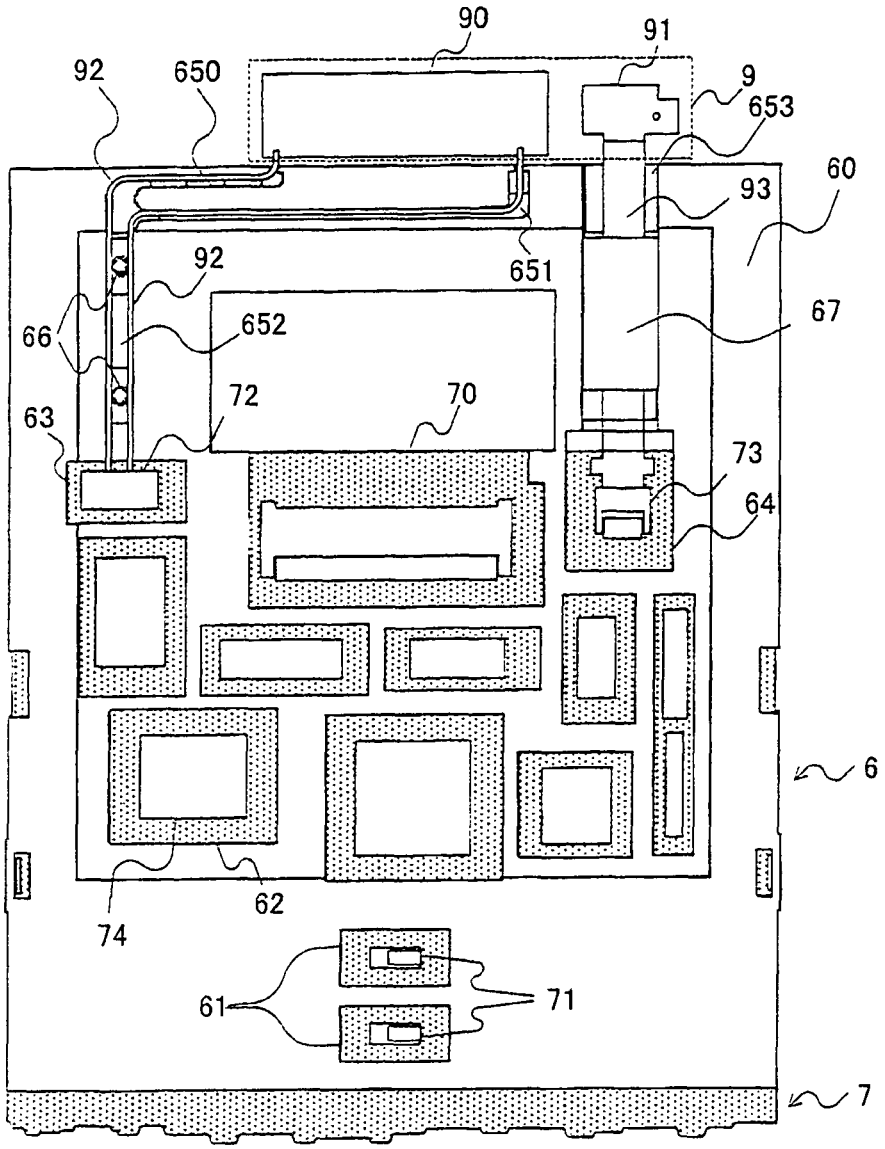
FIG. 8 shows an exemplary arrangement of the substrate module, the built-in equipment and the pressure plate in a mobile communication handset according to an exemplary embodiment.

Next, the arrangement of these constituent elements will be described. FIG. 8 shows an exemplary arrangement of the substrate module, the built-in equipment and the pressure plate in the mobile communication handset according to the exemplary embodiment. In FIG. 8, the substrate module 7 is positioned on the bottom-most plane (on back side of the page) and the pressure plate 6 is overlaid on top thereof (on the front side of the page). The power supply point contact unit 71, the cable A connection unit 72, the cable B connection unit 73 and the various electronic components 74 attached on the substrate 70 are respectively included within the range of the respective openings for the power supply point openings 61, the cable A connection unit opening 63, the cable B connection unit opening 64 and the electronic component openings 62 in the pressure plate 6. The pressure plate 6 touches the pressure plate 70 except at these openings. The pressure plate 6 and the substrate 70 are mutually anchored to each other by hooks. The bottom portion of the substrate module 7 shown in FIG. 8 is omitted.

The built-in equipment 9 is positioned at a location separated from the substrate 70 and the pressure plate 6. Sending and receiving signals between the built-in equipment 9 and the substrate 70 is accomplished for example via cable A 92, which is two single-core cables, and cable B 93, which is a flat multi-core cable. Cable A 92 is connected to the cable A connection unit 72 via the groove 650 for the cable A1, the groove 651 for the cable A2 and the groove 652 for the cable A in the pressure plate 6. The cable A anchoring unit 66 is positioned in the grove 652 for the cable A, and each of the cables A 92 are anchored in that position by passing between the groove 652 for the cable A and the cable A anchoring unit 66. The cable B 93 is connected to the cable B connection unit 73 via the groove 653 for the cable B. The cable B anchoring unit 67 is positioned in the groove 653 for the cable B, and the cable B 93 is anchored in that position by passing between the groove 653 for the cable B and the cable B anchoring unit 67.

Figure 9A:
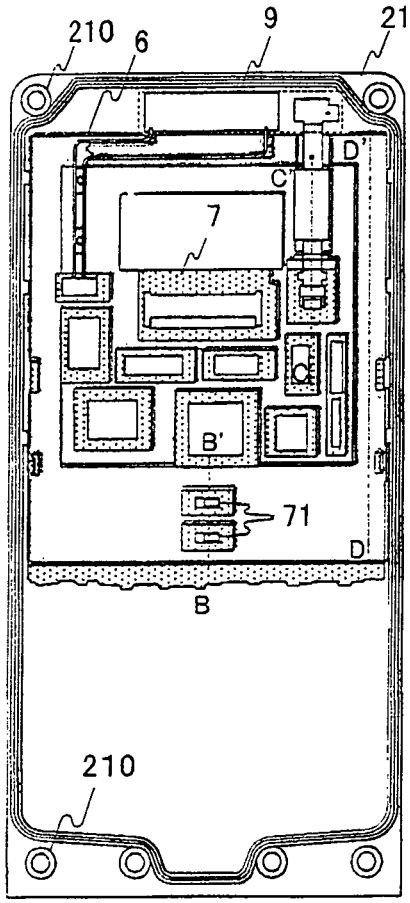
FIG. 9A shows the substrate module, the built-in equipment and the pressure plate arranged on the inside case of a mobile communication handset according to an exemplary embodiment.
Figure 9B:
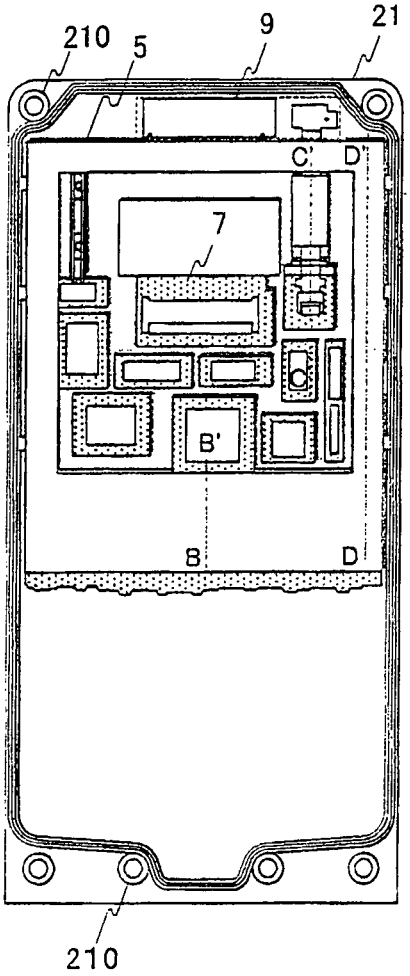
FIG. 9B shows the substrate module, the built-in equipment, the pressure plate and the antenna module arranged on the inside case of a mobile communication handset according to an exemplary embodiment.

FIG. 9A shows the substrate module, the built-in equipment and the pressure plate arranged on the inside case of the mobile communication handset according to the exemplary embodiment, and FIG. 9B shows the substrate module 7, the built-in equipment 9, the pressure plate 6 and the antenna module 5 arranged on the inside case 21 of the mobile communication handset according to the exemplary embodiment. In FIG. 9A, the substrate module 7, the built-in equipment 9 and the pressure plate 6 are arranged on the inside case 21 as shown in FIG. 8. The bottom portion of the substrate module 7 is omitted as in the case of FIG. 8. The surface of the inside case 21 in FIG. 9A shows the same surface as the inside case 21 in FIG. 53B, being the surface facing the operation unit 3 in FIG. 1. In FIGS. 9A and 9B, representation of the metal plate 8 positioned between the substrate module 7 and the inside case 21 is omitted. The metal plate 8 is anchored for example by double-sided adhesive tape or the like to the surface on the opposite side from the surface to which the electronic components 74 of the substrate 70 are attached.

In FIG. 9B, an antenna module 5 is further arranged on the pressure plate 6 shown in FIG. 9A. The antenna module 5 is arranged so that the surface on which the power supply points 52 are exposed is facing toward the pressure plate 6, and the power supply point contact units 71 and the power supply points 52 attached to the substrate 70 are in contact. At this time, a portion of the flexible substrate 50 on which the RFID antenna 51 of the antenna module 5 is formed corresponds to the position of the antenna pressing unit 60 of the pressure plate 6. The antenna module 5 is positioned overlaid on the pressure plate 6 in a state attached to the outside case 20 by means of double-sided adhesive tape or the like, but in FIG. 9B, the outside case 20 is omitted in order to clearly show the positional relationship between the antenna module 5 and the pressure plate 6.

With the antenna module 5 attached to the outside case 20 by means of double-sided adhesive tape, the antenna module 5 is positioned on the pressure plate 6 as shown in FIG. 9B and the outside case 20 and the inside case 21 are fastened together by the fastener units 200 and 210. In this manner the antenna housing unit 2 is comprised.

By fastening the outside case 20 and the inside case 21, the RFID antenna 51 of the antenna module 5 is anchored and pressed against the outside case 20 by the antenna pressing unit 60 of the pressure plate 6. By fastening the outside case 20 and the inside case 21 together because the power supply point contact units 71 on the substrate 70 are spring contacts, the power supply point contact units 71 and the power supply points 52 of the antenna module 5 are placed with certainty in conductive contact. In addition, the cable A 92 and the cable B 93 connected to the built-in equipment 9 are anchored to the pressure plate 6.

FIGS. 10A through 10C are cross-sectional views showing the anchoring state of the constituent elements. FIG. 10A is a cross-sectional view along line B-B' in the mobile communication handset in FIG. 9, FIG. 10B is a cross-sectional view along line C-C' in the mobile communication handset in FIG. 9 and FIG. 10C is a cross-sectional view along line D-D' in the mobile communication handset in FIG. 9. The positions of each of the cross-section lines B-B', C-C' and D-D' in FIGS. 10A through 10C are shown in FIG. 9.

The cross-section along line B-B' in FIG. 10A shows the conductive contact state between the power supply points 52 and the power supply point contact units 71 along with the anchoring state by the pressure plate 6 on the flexible substrate 50 on which the RFID antenna 51 is formed. With the exception of close to the power supply points 52, the flexible substrate 50 on which the RFID antenna 51 is formed is interposed between the outside case 20 and the inside case 21 and is anchored by being directly pressed against the outside case 20 by the antenna pressing unit 60 of the pressure plate 6. The power supply point contact units 71 are spring contacts, and by fastening the outside case 20 and the inside case 21 together, conductive contact is made certain between the power supply points 52 and the power supply point contact units 71.

The cross-section along line C-C' in FIG. 10B shows the anchoring state of cable B 93 to the pressure plate 6 and includes cable B 93, the cable B connection unit 73 and the cable B anchoring unit 67. The cable B 93 is connected to the cable B connection unit 73 via the lower portion of the cable B anchoring unit 67. Through this, the cable B 93 is anchored to the pressure plate 6.

The cross-section along line D-D' in FIG. 10C shows the anchoring state by the pressure plate 6 of the flexible substrate 50 on which the RFID antenna 51 is formed. The flexible substrate 50 on which the RFID antenna 51 is formed is interposed between the outside case 20 and the inside case 21 along with the metal plate 8, the substrate 70, the antenna pressing unit 60 of the pressure plate 6 and the magnetic sheet 53, and is anchored by being directly pressed against the outside case 20 by the antenna pressing unit 60 via the magnetic sheet 53.

The antenna pressing unit 60 of the pressure plate 6 is anchored as shown in FIGS. 10A and 10B, so the pressure plate 6 is similarly anchored and the cable B 93 anchored to the pressure plate 6 is also anchored to the antenna module 5. The same is also true of the cable A 92.

Next, the anchoring state of the antenna module 5 (RFID antenna 51) and the effects of this anchoring are described. As shown in FIG. 2, the antenna module 5 and the substrate module 7 are positioned on different planes. Consequently, the effects of the RFID antenna 51 properties by the substrate module 7 that has a problem in Patent Literature 1 are reduced. However, the RFID antenna 51 is formed on the flexible substrate 50, so if the RFID antenna 51 is not anchored in some way, the positioning including the gap between the RFID antenna 51 and the substrate module 7 may change. If such changes occur, communication properties (antenna properties) change by changing the resonant frequency of the RFID antenna 51.

By attaching the antenna module 5 to the outside case 20 by means of double-sided adhesive tape or the like, changes in the positioning between the antenna module 5 and the substrate module 7 can be reduced, but changes caused by the passing of time and changes caused by impact when the device is dropped may still occur.

As explained in the exemplary embodiment, by having a structure in which the RFID antenna 51 is interposed between the outside case 20 and the inside case 21 of the antenna housing unit 2, the RFID antenna 51 is directly pressed against and anchored to the outside case 20 by the pressure plate 6. Consequently, secular changes and changes in the positioning of the RFID antenna 51 due to impacts when dropped can be greatly reduced from changes in the past. Accordingly, it is possible to reduce changes in communication properties as well and to provide a mobile communication handset 1 having stable communication properties.

The power supply points 52 need to be in conductive contact with the power supply point contact units 71 formed on the substrate, so the pressure plate 6 cannot be positioned at the position of the power supply points 52. Consequently, the power supply point openings 61 are formed at positions facing the power supply points 52 in the pressure plate 6, and the span of those openings is large enough to include the power supply point contact units 71. In the example shown in FIG. 5, the power supply point openings 61 are provide independently, respectively to face the two power supply points 52, the openings are provided in a limited region near the power supply points 52, and the portion of the RFID antenna 51 other than the power supply points 52, including between the power supply points 52, is pressed against the outside case by the antenna pressing unit 60 of the pressure plate 6. Consequently, changes in the shape or positioning of the antenna module 5 are reduced and changes in communication properties caused by changes in the shape or positioning are reduced. The power supply point openings 61 may be one opening including the two power supply points 52, but by making these two independent openings, the effect is to further reduce changes in the position or deformation of the antenna module 5 near the power supply points 52.

Furthermore, even when an external stress is applied on this position by the device being dropped, it is possible to reduce changes in the position of the power supply points 52 and the RFID antenna 51 due to warping of the flexible substrate 50 near the power supply points 52. Consequently, it is less likely to cause troubles such as poor contact between the power supply points 52 and the power supply point contact units 71 to occur due to changes in the position of the power supply points 52.

It is possible to make conductive contact with the power supply points 52 more certain because the power supply point contact units 71 are spring contacts. In addition, the antenna housing unit 2 protects the antenna module 5 and the like by restricting the spring stroke of the power supply point contact units 71 by having a structure in which the antenna module 5 is interposed between the outside case 20 and the inside case 21 via the pressure plate 6. Consequently, it is possible to improve impact resistance.

Communication properties also change due to changes in the position of cables in the vicinity of the antenna out of the cables used to send and receive signals between the built-in equipment 9 and the substrate module 7. As already explained, the pressure plate 6 has the cable groove 65 (the groove 650 for the cable A1, the grove 651 for the cable A2, the groove 652 for the cable A and the groove 653 for the cable B), the cable A anchoring unit 66 and the cable B anchoring unit 67, so the cable A 92 and the cable B 93 connected to the built-in equipment 9 are anchored to the pressure plate 6 by the cable groove 65, the cable A anchoring unit 66 and the cable B anchoring unit 67 (in this case, the cable anchoring unit may be thought of as a combination of grooves and anchoring units within the groove 650 for the cable A1, the grove 651 for the cable A2, the groove 652 for the cable A and the groove 653 for the cable B). The pressure plate 6 presses the RFID antenna 51 toward the outside case 20, so changes in the positioning of the pressure plate 6 and the RFID antenna 51 are reduced. Accordingly, changes in the positioning of the cable A 92, the cable B 93 and the RFID antenna 51 can be reduced and changes in communication properties can be reduced more than changes in the past. This also has an effect on reducing variances in positioning the cables and the RFID antenna when assembling the antenna housing unit 2. Consequently, this has an effect on reducing variance in the resonant frequency of the RFID antenna 51 as well.

Openings are provided in the pressure plate 6 in order to eliminate interference with the electronic components 74 in locations where the electronic components 74 and the like are attached. As there are these openings, it is possible to reduce the gap between the substrate 70 and the pressure plate 6. Consequently, it is possible to reduce the thickness of the antenna housing unit 2 as compared with cases in which openings are not provided.

Figure 11:
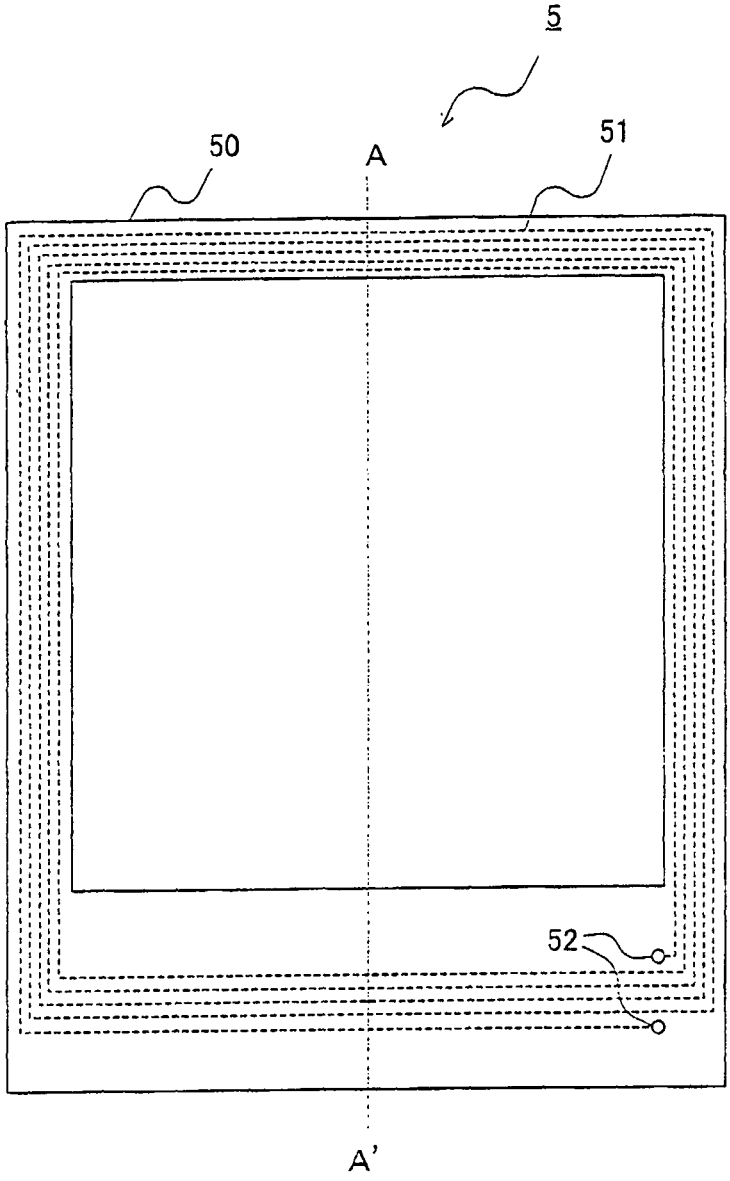
FIG. 11 is a planar view showing the composition of an antenna module in a mobile communication handset according to an exemplary embodiment.

FIG. 11 shows an exemplary embodiment on the position of the power supply points 52 in the antenna module 5. The power supply points 52 shown until now are positioned near the axis of symmetry A-A' on the antenna formation surface of the antenna module 5, as shown in FIG. 4A. In the exemplary embodiment shown in FIG. 11, the power supply points 52 are positioned closer to the edge of the antenna module 5 than the axis of symmetry A-A'.

As the power supply points 52 are placed closer to the edge of the antenna module 5 than the axis of symmetry A-A', changes in the position of the power supply points 52 due to warping of the flexible substrate 50 can be reduced. By reducing change in the position of the RFID antenna 51 with respect to the substrate module 7 because the RFID antenna 51 is connected to the power supply points 52, it is possible to further reduce change in communication properties. Moreover, even when an external stress by dropping is applied to the edge of the antenna module 5, it is possible to further reduce changes in position caused by warping of the power supply points 52. Consequently, it is less likely to cause troubles such as poor contact between the power supply points 52 and the power supply point contact units 71 to occur due to changes in the position of the power supply points 52.

In the antenna module 5, antenna sensitivity can be improved by providing the magnetic sheet 53. The magnetic sheet 53 has previously been attached to the part where the RFID antenna 51 is formed with the exception of the power supply points 52, but this is not to be limited. The magnetic sheet 53 may be attached including the openings in the antenna module 5 with the exception of near the power supply points 52, as long as there is no interference with the cable A connection unit 72, the cable B connection unit 73 and the electronic components 74. The object in attaching the magnetic sheet 53 is to improve magnetic flux density passing through the loop the RFID antenna 51 forms, so it is desirable to attach the magnetic sheet 53 to include the openings of the antenna module 5 to the extent possible. In addition, openings may be formed at corresponding locations in the magnetic sheet 53 when the sheet interferes with the cable A connection unit 72, the cable B connection unit 73 and the electronic components 74.

When a pressure plate 6 composed of magnetic materials is used, the pressure plate 6 can substitute for the functions of the magnetic sheet 53 and the entirety of the pressure plate excepting the openings becomes a magnetic body. Consequently, it is possible to cover a larger surface area of the RFID antenna 51 with magnetic material, with the effect of improving antenna sensitivity. However, it is necessary that the pressure plate 6 faces is arranged to face the circuit formation part of the substrate module 7 and places where the pressure plate 6 touches the substrate module 7 have insulating properties, because the pressure plate 6 touches the substrate module 7. Consequently, it is preferable to form the pressure plate 6 of an insulating material. As has already been explained, the pressure plate 6 may also be coated with an insulating material.

The case where a flexible substrate 50 is used as the thin substrate 50 forming the RFID antenna 51 has already been explained, as well as the flexible substrate 50, but even with a thin antenna in which the antenna is formed on a thin substrate 50 that is not a flexible substrate 50, there are concerns that warping due to secular changes in the thin substrate and changes in positioning caused by impacts could occur. Consequently, by utilizing the pressure plate 6 it is possible to reduce changes in the positioning of the antenna module 5 the same as when utilizing the flexible substrate 50, and accordingly it is possible to reduce changes in communication properties.

The present invention has been explained using an example of an RFID antenna 51 as an antenna, but the antenna need not be limited to RFID antennas 51, for the same efficacy as that explained above can be achieved by introducing the pressure plate to any kind of antenna that is a thin antenna formed on a thin substrate, including a flexible substrate 50.

Having described and illustrated the principles of this application by reference to one or more preferred embodiments, it should be apparent that the preferred embodiment may be modified in arrangement and detail without departing from the principles disclosed herein and that it is intended that the application be construed as including all such modifications and variations insofar as they come within the spirit and scope of the subject matter disclosed herein.

INDUSTRIAL APPLICABILITY

The mobile communication handset of the present invention is useful in having a built-in thin antenna and reducing changes in communication properties.

The above embodiments are partly or entirely described as in the following supplementary notes, but not restricted thereto.

(Supplementary Note 1)

A mobile communication handset comprising an antenna housing unit having:

an antenna module in which an antenna and two power supply points for said antenna are formed on a thin substrate;

a substrate module including a substrate, two power supply point contact units for electrically contacting said two power supply points, and electronic components, and comprising a circuit formed on said substrate and containing said electronic components and said power supply point contact unit attached on said substrate, said substrate module processing signals received from said circuit via said power supply point contact unit; and an outside case and an inside case for housing said antenna module and said substrate module;

wherein said mobile communication handset comprises a pressure plate positioned between said antenna module and said substrate, and has openings for said power supply points positioned facing said power supply points, with the entire surface of said antenna module, with the exception of said power supply points, being pressed against and anchored to said outside case by fastening said outside case and said inside case together.

(Supplementary Note 2)

The mobile communication handset according to Supplementary note 1, wherein said thin substrate is a flexible substrate.

(Supplementary Note 3)

The mobile communication handset according to Supplementary note 1, further comprising built-in equipment positioned separated from said substrate;

wherein said pressure plate comprises a cable anchoring unit for anchoring the positions of cables linking said built-in equipment with circuits formed on said substrate.

(Supplementary Note 4)

The mobile communication handset according to Supplementary note 1, wherein said openings for said power supply points are created independently with respect to said two power supply points and said pressure plate faces the part of said antenna module positioned between said two power supply points.

(Supplementary Note 5)

The mobile communication handset according to Supplementary note 1, wherein said pressure plate has openings encompassing said electronic components at positions facing said electronic components arranged on said substrate.

(Supplementary Note 6)

The mobile communication handset according to Supplementary note 1, wherein said pressure plate is formed of an insulator material.

(Supplementary Note 7)

The mobile communication handset according to Supplementary note 1, wherein said pressure plate is formed of a magnetic material.

(Supplementary Note 8)

The mobile communication handset according to Supplementary note 1, wherein said power supply point contact units are spring contacts.

(Supplementary Note 9)

The mobile communication handset according to Supplementary note 1, wherein said power supply points are positioned toward the edge from the antenna axis of symmetry on the antenna formation surface of said antenna module.

(Supplementary Note 10)

The mobile communication handset according to Supplementary note 1, wherein said antenna module comprises a magnetic sheet on a certain side of said substrate.

LEGEND

1 mobile communication handset
2 antenna housing unit
3 operation unit
4 hinge unit
5 antenna module
6 pressure plate
7 substrate module
8 metal plate
9 built-in equipment
20 outside case
21 inside case
40 hinge shaft
41 antenna housing side hinge unit
42 operation side hinge unit
50 thin substrate (flexible substrate)
51 antenna (RFID antenna)
52 power supply points
53 magnetic sheet
60 antenna pressing unit
61 power supply point openings
62 electronic component openings
63 cable A connection unit openings
64 cable B connection unit openings
65 cable grooves
66 cable A anchoring unit
67 cable B anchoring unit
70 substrate
71 power supply point contact units
72 cable A connection unit
73 cable B connection unit
74 electronic components
90 built-in equipment A
91 built-in equipment B
92 cable A
93 cable B
200 fastener unit
210 fastener unit
650 groove for the cable A1
651 groove for the cable A2
652 groove for the cable A
653 groove for the cable B

What is claimed is:

1. A mobile communication handset comprising an antenna housing unit having:

an antenna module in which an antenna and two power supply points for said antenna are formed on a thin substrate;

a substrate module including a substrate, two power supply point contact units for electrically contacting said two power supply points, and electronic components, and comprising a circuit formed on said substrate and containing said electronic components and said power supply point contact unit attached on said substrate, said substrate module processing signals received from said circuit via said power supply point contact unit; and an outside case and an inside case for housing said antenna module and said substrate module;

wherein said mobile communication handset comprises a pressure plate positioned between said antenna module and said substrate, and has openings for said power supply points positioned facing said power supply points, with the entire surface of said antenna module, with the exception of said power supply points, being pressed against and anchored to said outside case by fastening said outside case and said inside case together.

2. The mobile communication handset according to claim 1, wherein said thin substrate is a flexible substrate.

3. The mobile communication handset according to claim 1, further comprising built-in equipment positioned separated from said substrate;

wherein said pressure plate comprises a cable anchoring unit for anchoring the positions of cables linking said built-in equipment with circuits formed on said substrate.

4. The mobile communication handset according to claim 1, wherein said openings for said power supply points are created independently with respect to said two power supply points and said pressure plate faces the part of said antenna module positioned between said two power supply points.

5. The mobile communication handset according to claim 1, wherein said pressure plate has openings encompassing said electronic components at positions facing said electronic components arranged on said substrate.

6. The mobile communication handset according to claim 1, wherein said pressure plate is formed of an insulator material.

7. The mobile communication handset according to claim 1, wherein said pressure plate is formed of a magnetic material.

8. The mobile communication handset according to claim 1, wherein said power supply point contact units are spring contacts.

9. The mobile communication handset according to claim 1, wherein said power supply points are positioned toward the edge from the antenna axis of symmetry on the antenna formation surface of said antenna module.

10. The mobile communication handset according to claim 1, wherein said antenna module comprises a magnetic sheet on a certain side of said substrate.

* * * * *